US008740320B2

(12) United States Patent
Eng

(10) Patent No.: US 8,740,320 B2
(45) Date of Patent: Jun. 3, 2014

(54) DISHWASHER WITH ERGONOMIC CLOSURE DEVICE

(75) Inventor: Lindsay Eng, Long Beach, CA (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/400,602

(22) Filed: Feb. 21, 2012

(65) Prior Publication Data

US 2013/0113351 A1 May 9, 2013

Related U.S. Application Data

(63) Continuation-in-part of application No. 29/405,771, filed on Nov. 7, 2011, now Pat. No. Des. 665,957.

(51) Int. Cl.
*A47B 88/00* (2006.01)

(52) U.S. Cl.
USPC ..... 312/328

(58) Field of Classification Search
USPC ..... 312/330.1, 326–329, 215, 222
See application file for complete search history.

(56) References Cited

U.S. PATENT DOCUMENTS

| | | | | | |
|---|---|---|---|---|---|
| D214,193 | S | | 5/1969 | Swartz | |
| 4,732,430 | A | * | 3/1988 | Byrns | 312/330.1 |
| D320,489 | S | * | 10/1991 | Marks et al. | D32/3 |
| 5,496,105 | A | * | 3/1996 | Czarnecky et al. | 312/334.4 |
| D373,860 | S | | 9/1996 | Manke | |
| D424,257 | S | * | 5/2000 | Umeda et al. | D32/2 |
| 6,527,353 | B1 | * | 3/2003 | Bradfish et al. | 312/332.1 |
| 6,893,061 | B2 | * | 5/2005 | Miller et al. | 292/303 |
| 7,216,944 | B2 | * | 5/2007 | Oyler et al. | 312/311 |
| D544,657 | S | * | 6/2007 | Jung et al. | D32/2 |
| D627,938 | S | * | 11/2010 | Kim | D32/2 |
| D665,957 | S | * | 8/2012 | Eng et al. | D32/2 |
| D668,402 | S | * | 10/2012 | Eng et al. | D32/3 |
| D668,403 | S | * | 10/2012 | Eng et al. | D32/3 |
| D670,457 | S | * | 11/2012 | Eng | D32/3 |
| D673,742 | S | * | 1/2013 | Eng et al. | D32/2 |

FOREIGN PATENT DOCUMENTS

EP 0388375 A2 9/1990

OTHER PUBLICATIONS

Fisher & Paykel, DishDrawer Model DD24SCTW6V2, published 2010, pp. 48.
General Electric Company, GE profile Wine Center, published 2006, pp. 8.
Turbo Air Inc., Turbo Air TBD-2SD Beer Dispenser & Club Top, published 2002, pp. 13.
Gorenje UK ltd., Built-In Oven BO87KR, published 2011, pp. 1.
Liebherr-International AG, Liebherr Wine Storage Cabinet HWS 1800, published 2011, pp. 1.

* cited by examiner

*Primary Examiner* — Darnell Jayne
*Assistant Examiner* — Timothy M Ayres
(74) *Attorney, Agent, or Firm* — James E. Howard; Andre Pallapies

(57) ABSTRACT

A dishwasher comprises a compartment to hold items to be washed and/or dried, the compartment including a front opening; a closure device to sealingly close the opening, the closure device being movable between open and closed positions; and an insert having a front side with a portion that is flush or substantially flush with a front surface of the closure device. The insert includes a recessed handle that is inwardly recessed into the front face of the closure device. The handle is elongated in a horizontal sense and to such an extent that the handle is accessible by a user when standing at a position laterally adjacent the dishwasher, (e.g., in front of a sink) to better avoid the need for the user to lean over to access the center of the dishwasher.

24 Claims, 12 Drawing Sheets

DISHWASHER WITH ERGONOMIC CLOSURE DEVICE

CROSS-REFERENCE TO APPLICATION

This application is a continuation-in-part of U.S. Design application No. 29/405,771, filed Nov. 7, 2011.

FIELD OF TECHNOLOGY

The present technology relates to home appliances, in particular to an ergonomically designed dishwasher closure device, e.g., a door, to allow access and closing of the dishwasher compartment.

BACKGROUND OF TECHNOLOGY

Current dishwashers include doors or drawers that are movable by a user by pulling on a handle to either pivot the door about a horizontal axis, or pull the drawer open. Typically, such doors and drawers include a handle or handle assembly that is limited to a central location and/or that protrudes at least a certain extent from the front and/or top surface of the door. Examples of such appliances include patent Nos. U.S. D214,193, U.S. D373,860, and EP0388375.

SUMMARY OF TECHNOLOGY

One aspect of the disclosed technology relates to a handle for a home appliance (e.g., a dishwasher) that addresses one or more of the shortcomings of the prior art.

Another aspect of the disclosed technology relates to a dishwasher having a door that is pivotable about a horizontal axis, which door includes an elongated handle that allows the user, e.g., positioned to the lateral left or right side of the dishwasher (e.g., in front of a sink), to open the door without needing to lean over and open the door at its center.

Another aspect of the disclosed technology relates to a dishwasher comprising a compartment to hold items to be washed and/or dried, the compartment including a front opening; a door to sealingly close the opening, the door being pivotably attached to the compartment to allow pivoting about an axis between open and closed positions; and a recessed handle inwardly recessed into a front face of the door, the handle being elongated in a horizontal sense, generally parallel to the axis, and to such an extent that the handle is accessible by a user when standing at a position laterally adjacent the dishwasher.

Another aspect of the disclosed technology relates to a dishwasher comprising a compartment to hold items to be washed and/or dried, the compartment including a front opening; a closure device (e.g., a door or drawer) to sealingly close the opening, the closure device being movable between open and closed positions; and an insert having a front side with a portion that is flush or substantially flush with a front surface of the closure device, the insert including a recessed handle that is inwardly recessed into the front face of the closure device, the handle being elongated in a horizontal sense and to such an extent that the handle is accessible by a user when standing at a position laterally adjacent the dishwasher.

Another aspect of the disclosed technology is directed towards a dishwasher comprising a compartment to hold items to be washed and/or dried, the compartment including a front opening; a door to sealingly close the opening, the door being pivotably attached to the compartment to allow pivoting about an axis between open and closed positions, the door including a main body and a one piece shell attached to the main body, the shell having a top portion with a generally U-shape and including upstanding arm portions; and a recessed handle inwardly recessed into a front face of the shell, the handle being elongated in a horizontal sense, generally parallel to the axis, and to such an extent that the handle is accessible by a user when standing at a position laterally adjacent the dishwasher, the handle being positioned between the upstanding arm portions of the U-shape.

Other aspects, features, and advantages of this technology will become apparent from the following detailed description when taken in conjunction with the accompanying drawings, which are a part of this disclosure and which illustrate, by way of example, principles of this technology.

BRIEF DESCRIPTION OF THE DRAWINGS

The accompanying drawings facilitate an understanding of the various examples of this technology. In such drawings.

DETAILED DESCRIPTION OF ILLUSTRATED EXAMPLES

The following description is provided in relation to several examples (most of which are illustrated, some of which may not) which may share common characteristics and features. It is to be understood that one or more features of any one example may be combinable with one or more features of the other examples. In addition, any single feature or combination of features in any example or examples may constitute patentable subject matter.

Figure 1:
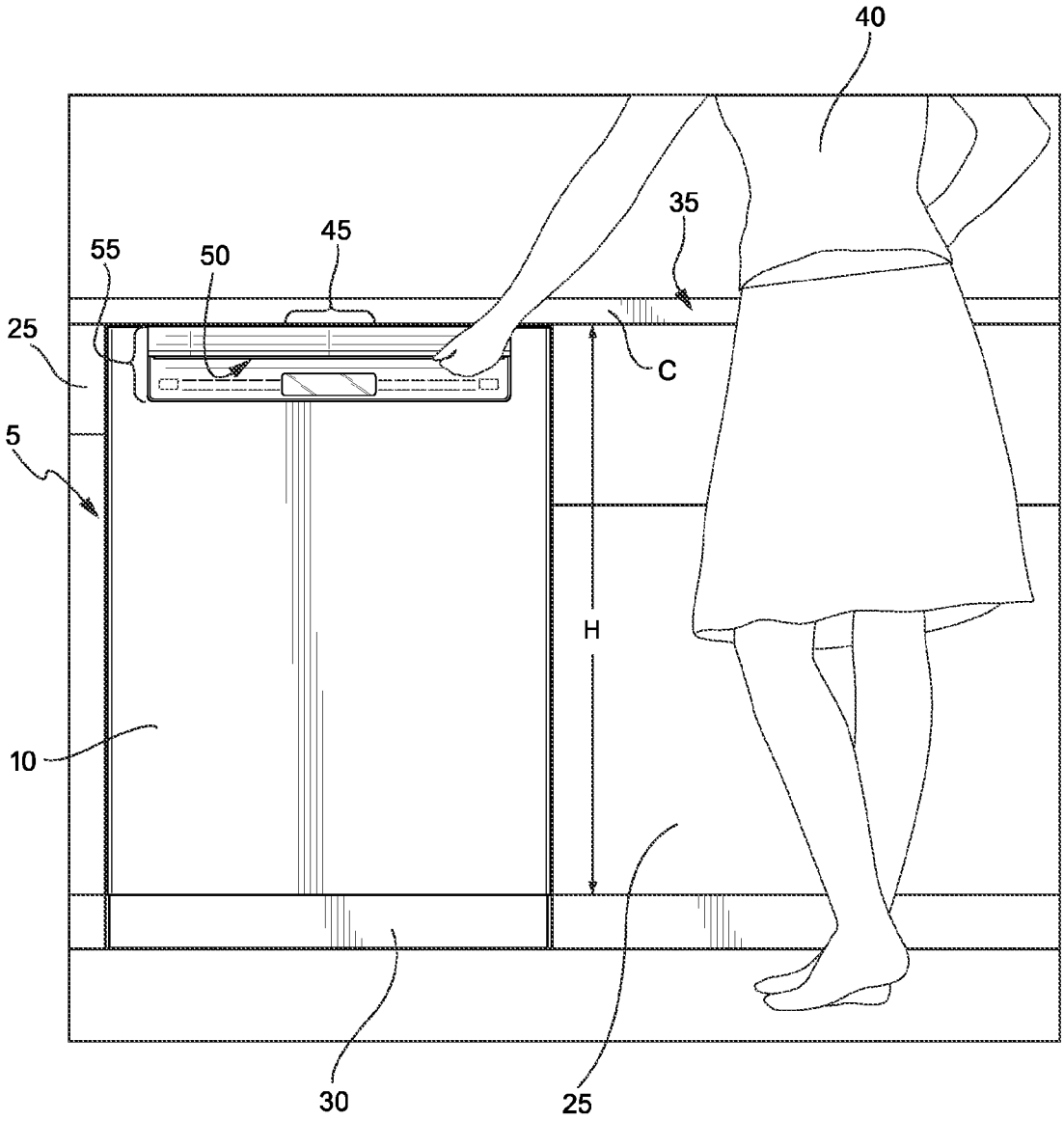
FIG. 1 is a dishwasher according to an example of the present technology.
Figure 3:
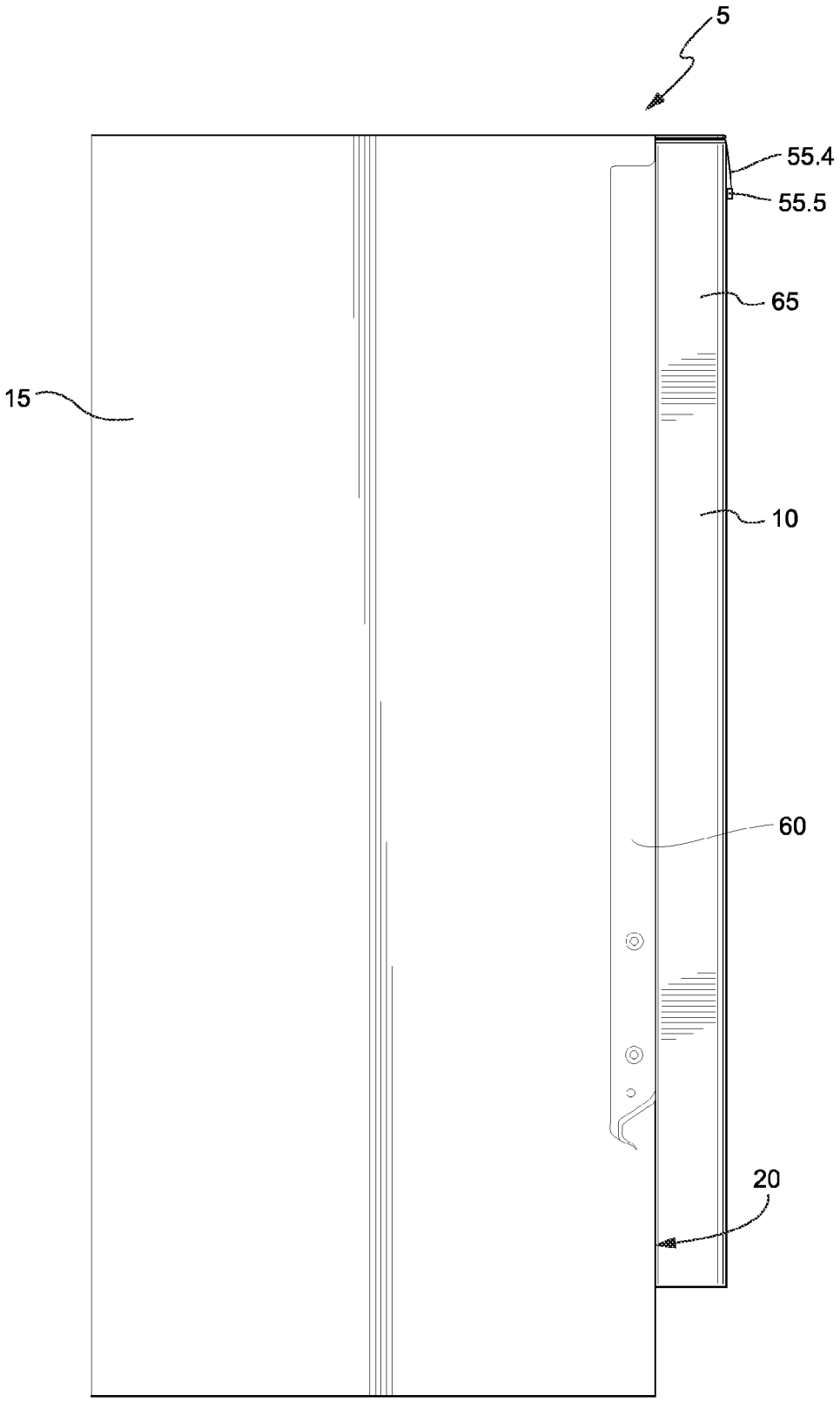
FIG. 3 is a side view thereof.

FIG. 1 is a schematic view of a dishwasher 5 for washing and/or drying crockery items, such as dishes, frying pans, cookie sheets, cutting boards, bowls, pots, etc. Dishwasher 5 includes a manually openable closure device, e.g., a door 10, and a compartment 15 (FIG. 3). Door 10 is openable to allow access to a front opening 20 of the compartment 15, e.g., by pivoting about a generally horizontal axis A between open and closed positions. Door 10 will form a generally water/air tight seal relative to the opening 20 of the compartment 15 when closed. The compartment 15 includes at least one crockery basket and/or cutlery basket. The closure device may also take the form of a drawer that is slidable between the open and closed positions.

The dishwasher 5 is typically mounted adjacent other kitchen appliances and/or cabinetry 25, and may include a continuous or separate kick plate 30 to provide a finished, uniform look. In a well planned kitchen, the dishwasher 5 will be placed adjacent a sink 35 such that items to be cleaned/dried can be conveniently transferred from the sink 35 to the dishwasher 5.

As can be seen in FIG. 1, to allow access to the dishwasher compartment, a user 40 (e.g., a 50$^{th}$ percentile adult male or female) may grasp a portion of the dishwasher door 5 for opening same. The portion that is grasped is advantageously elongated in the horizontal sense so that the compartment 15 may be accessed by the user 40 who is shown as standing or positioned to the left or right of the dishwasher 5, e.g., at the sink 35. This avoids the need for the user 40 to lean over to open the door at its center point or center 45.

Figure 2:
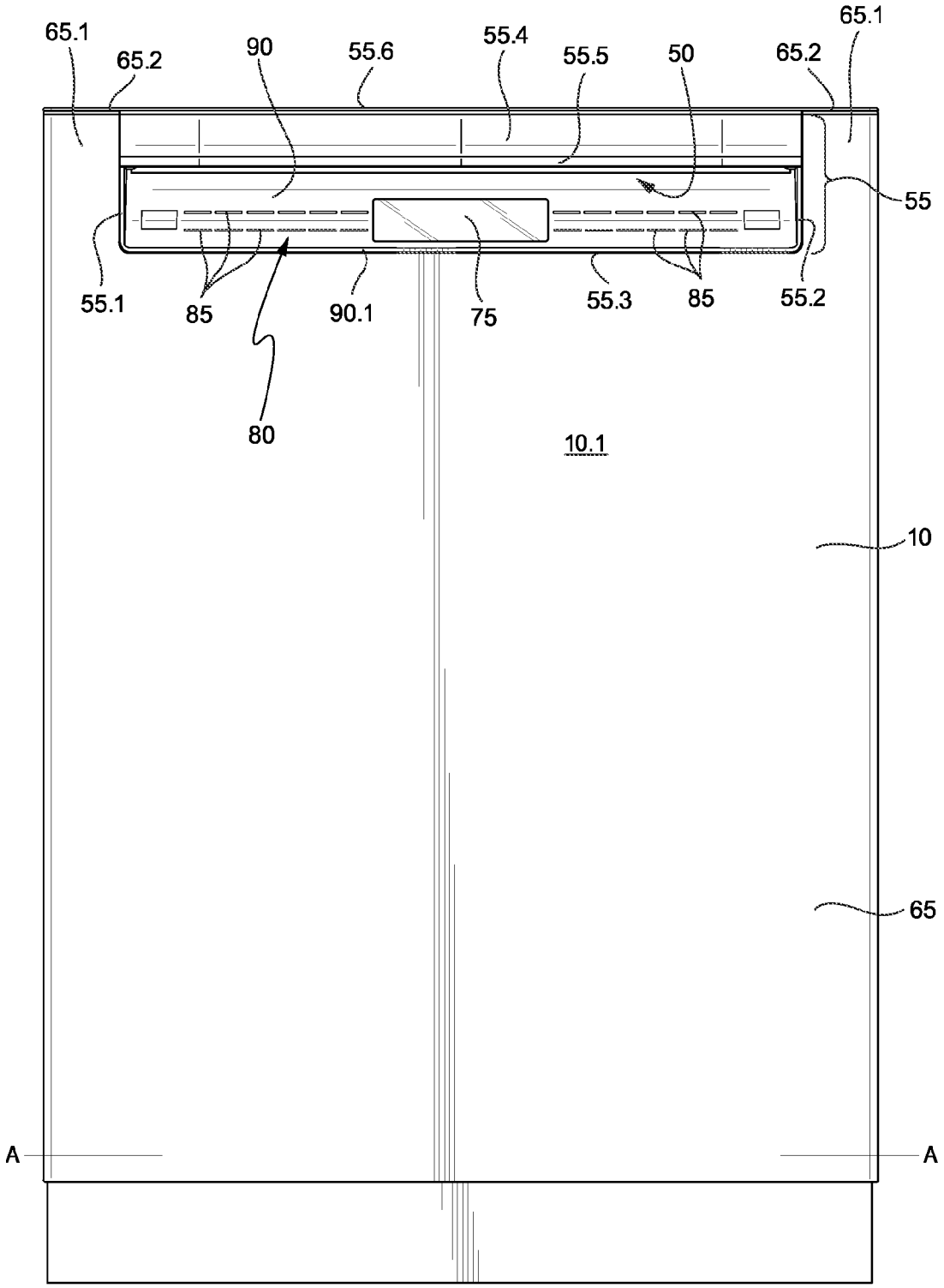
FIG. 2 is a front view of the dishwasher showing the door in isolation of FIG. 1 in isolation.

As shown in FIG. 2, the portion that is grasped may be in the form of a handle 50. Handle 50 may be formed with or attached to an insert 55 having a front side with at least a portion that is flush or substantially flush with a front surface of the door. For example, the left 55.1, right 55.2 and bottom 55.3 sides of the insert 55 are flush with door 10, although an upper portion (fascia 55.4 or (chrome) strip 55.5) of the insert may slightly protrude, in convex fashion, away from a front face 10.1 of the door 10. The handle 50 is inwardly recessed into the front face 10.1 of the door 10, the handle 50 being elongated in a horizontal sense and to such an extent that the handle 10 is accessible by the user when standing at a position laterally adjacent the dishwasher.

Figure 4:
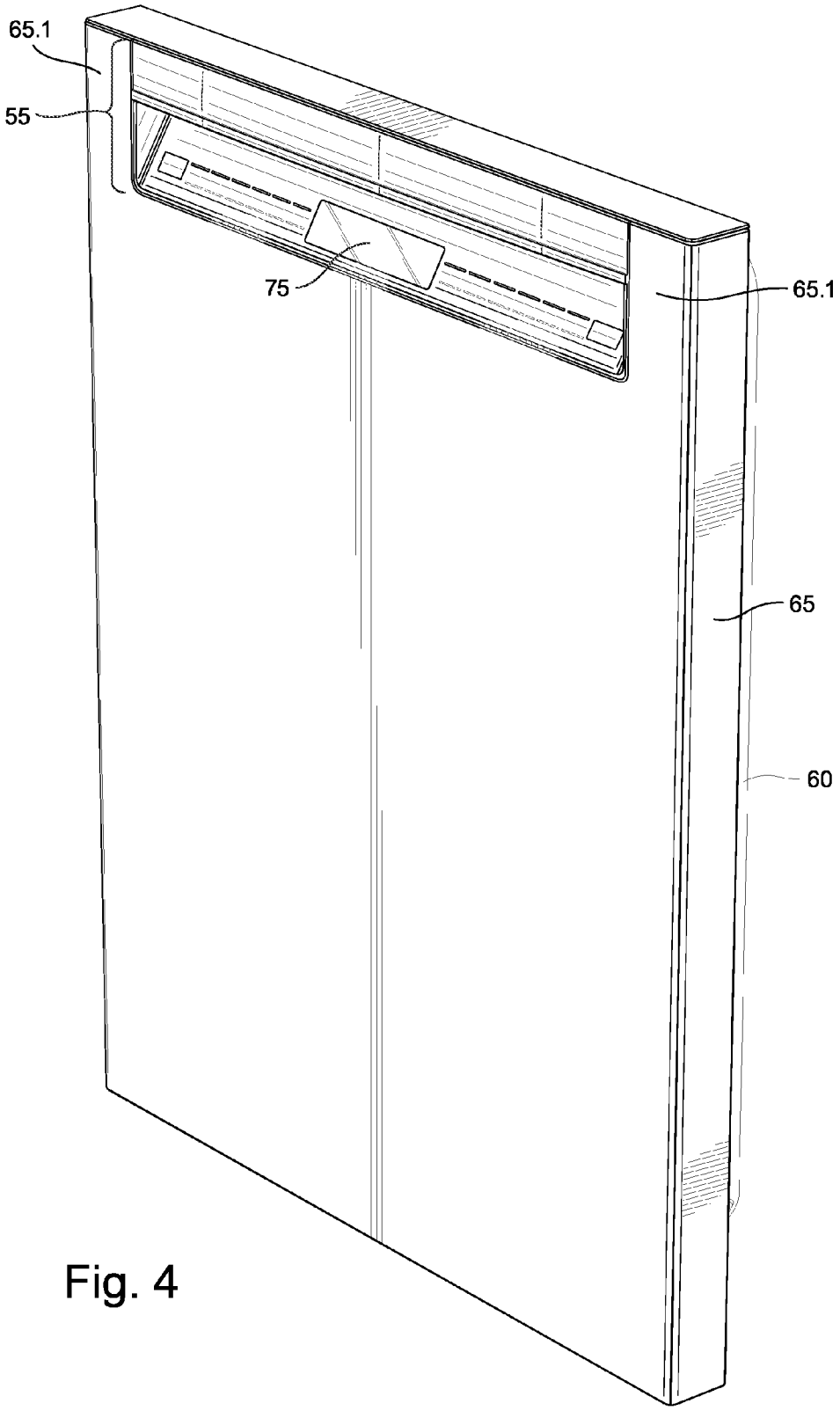
FIG. 4 is a perspective view thereof.
Figure 5:
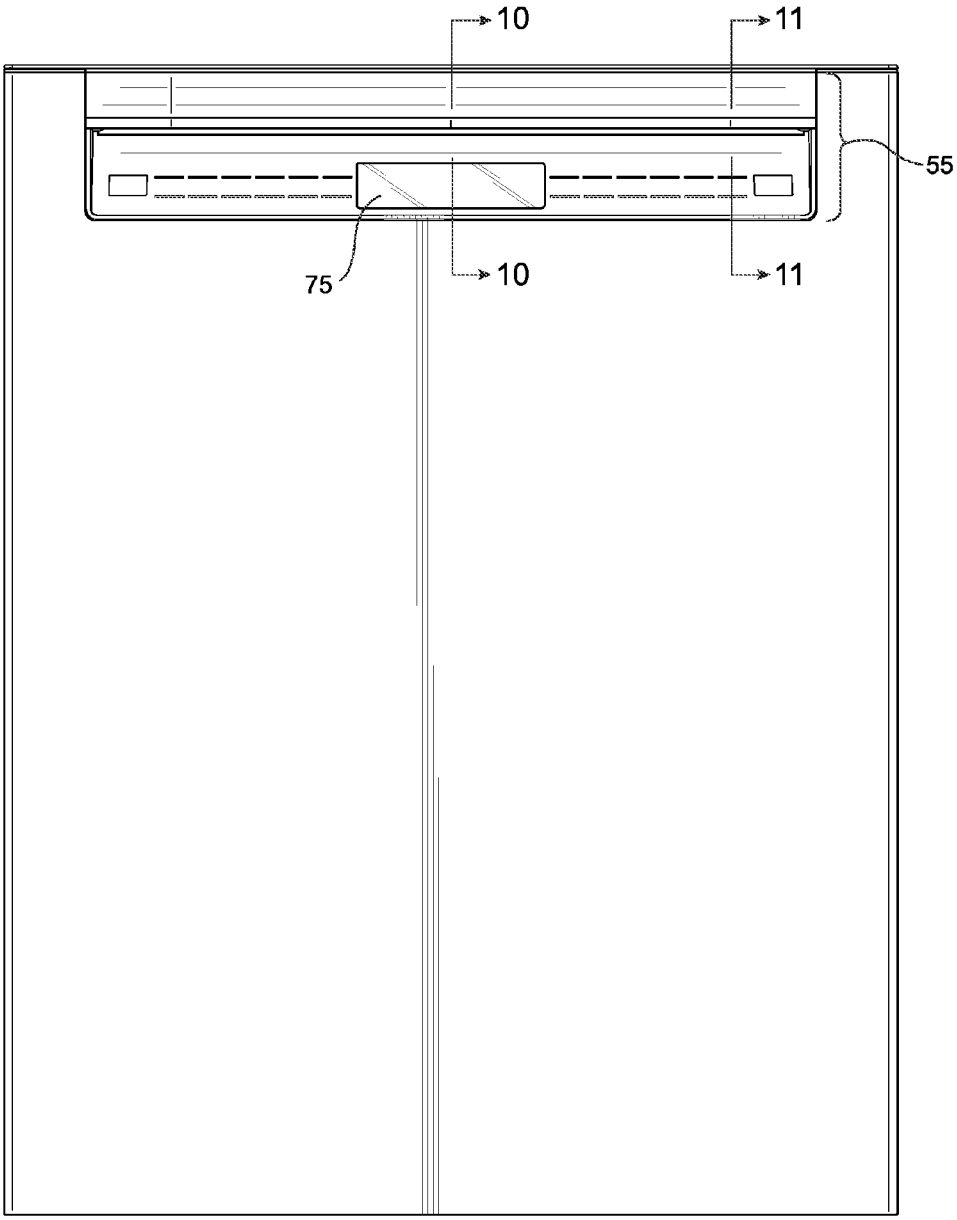
FIG. 5 is a front view thereof.
Figure 6:
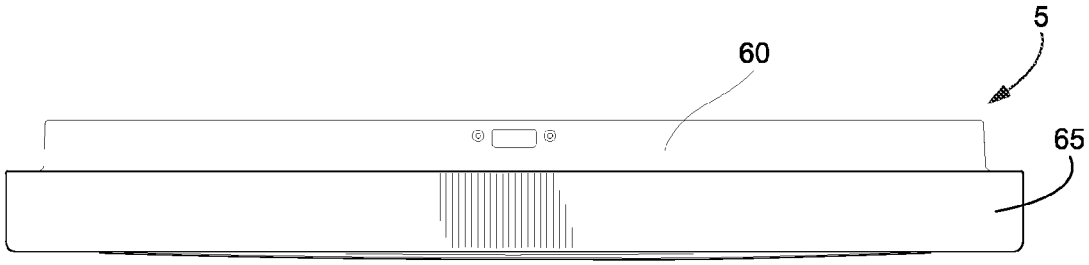
FIG. 6 is a top view thereof.
Figure 7:
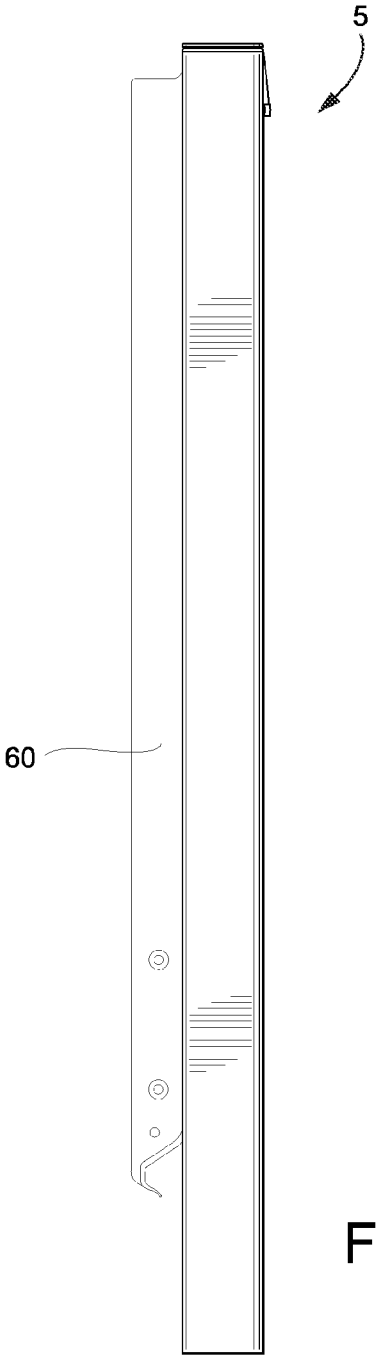
FIG. 7 is a left side view thereof.
Figure 8:
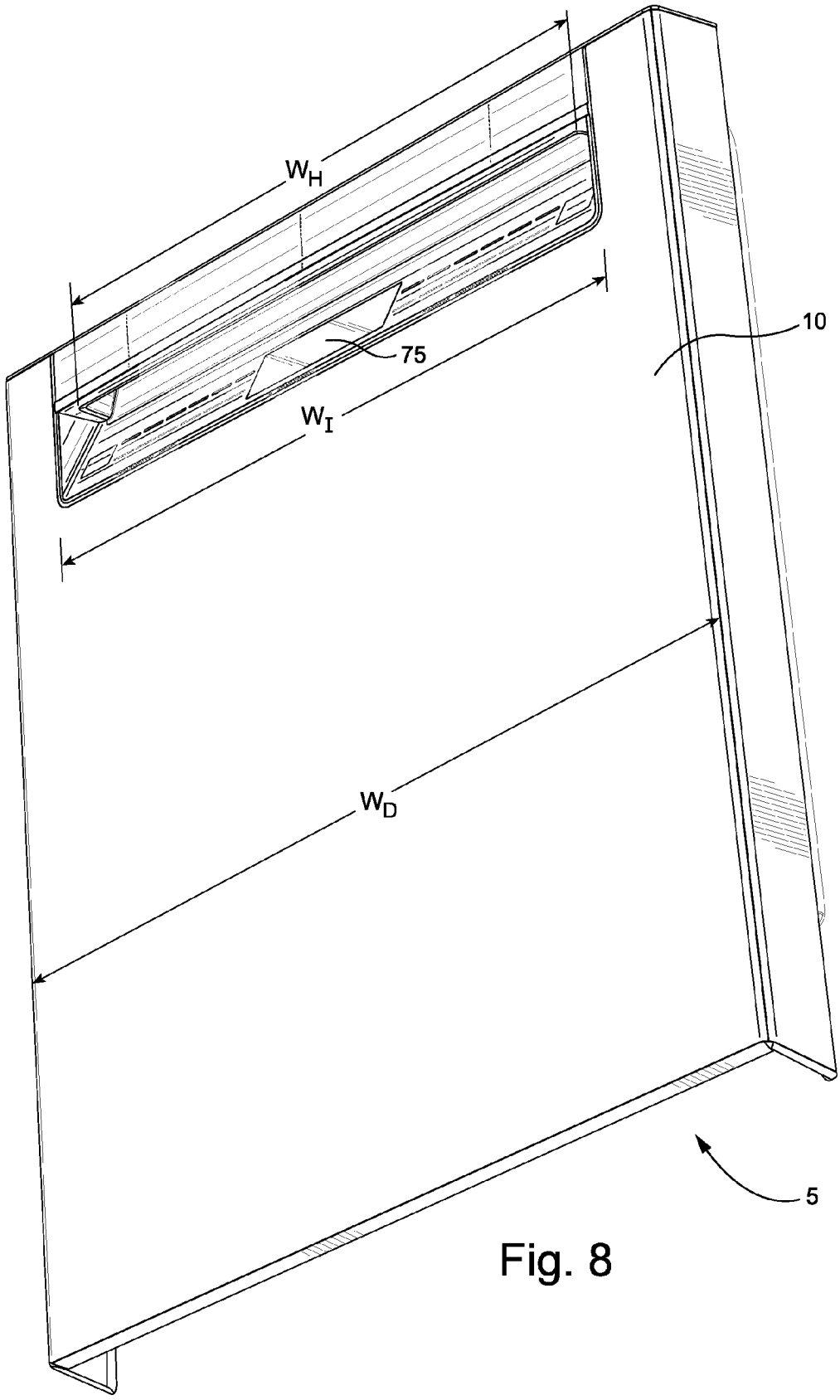
FIG. 8 is a perspective view thereof from the bottom.
Figure 10:
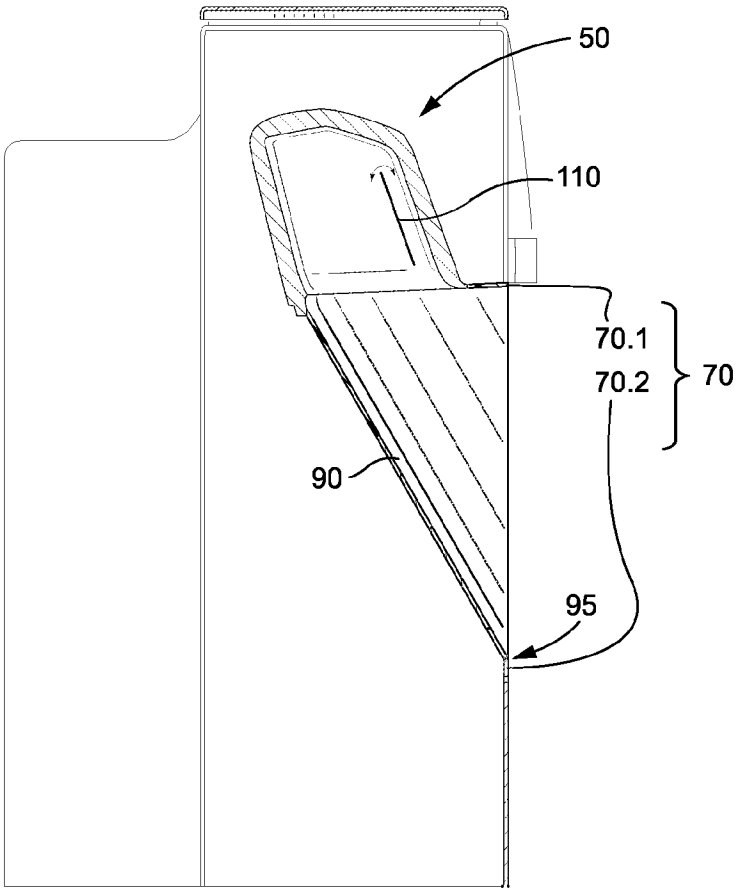
FIG. 10 is a cross section taken along line 10-10 of FIG. 5.
Figure 12:
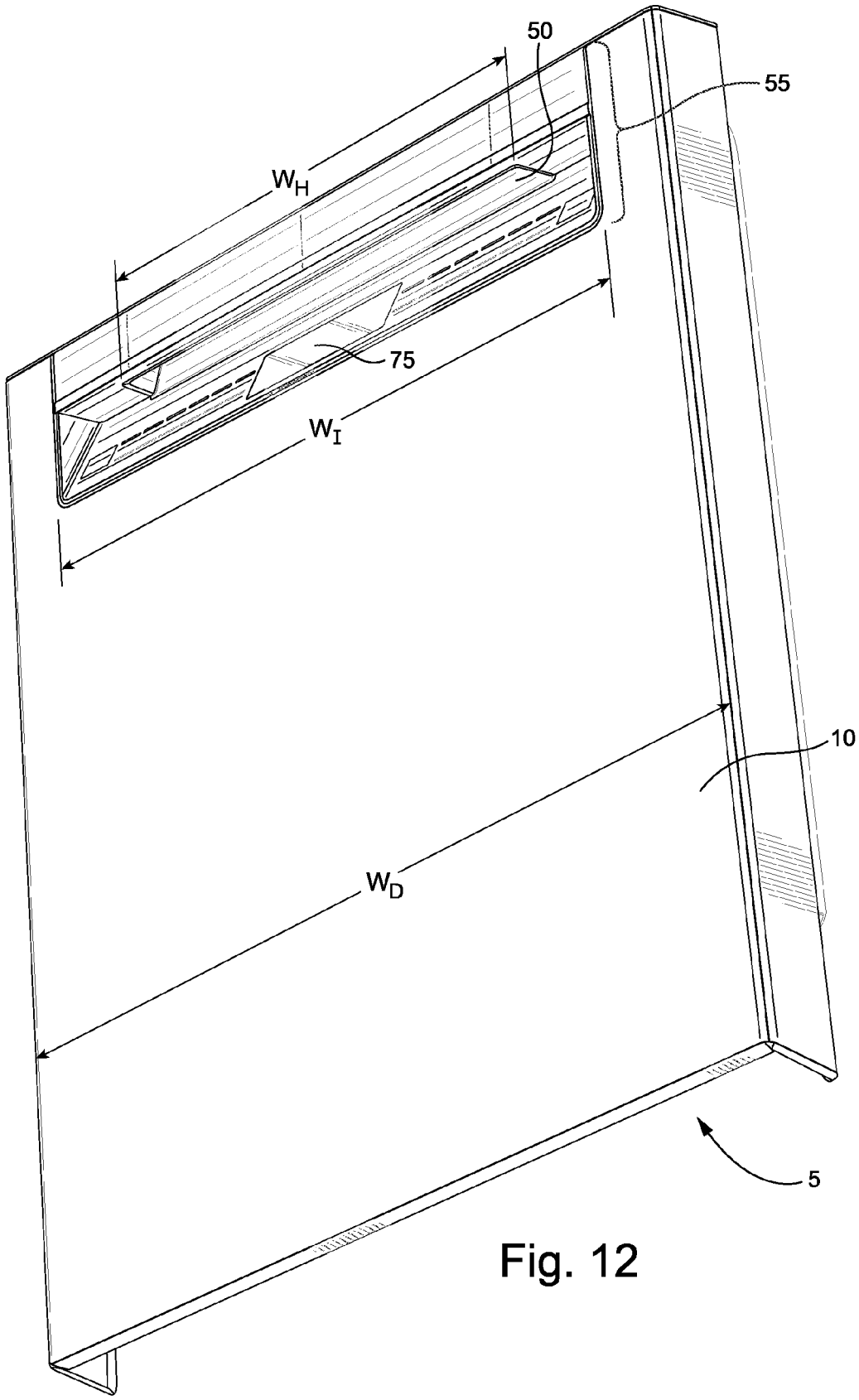
FIGS. 12-14 are dishwashers according to further examples of the present technology.
Figure 13:
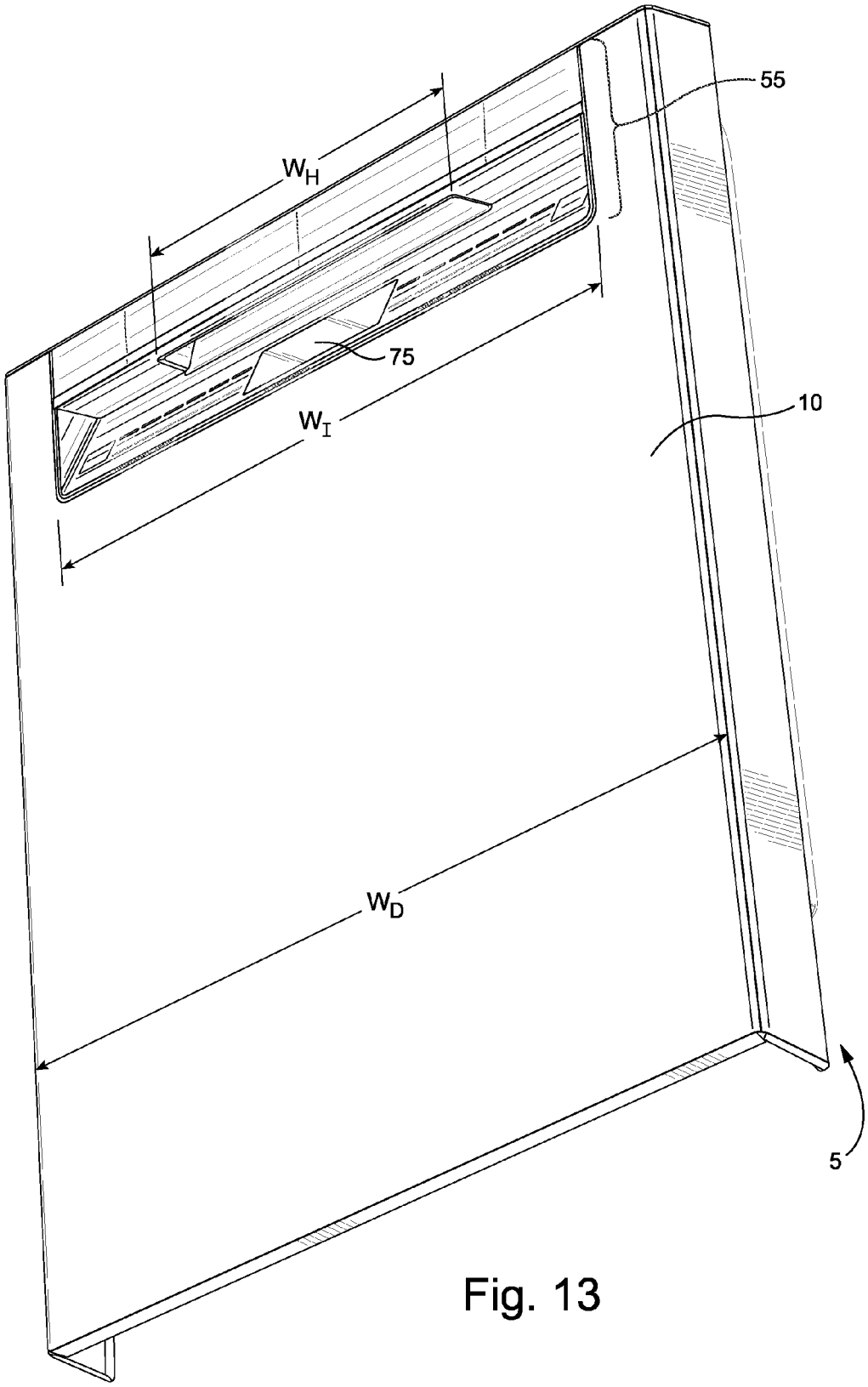
Figure 14:
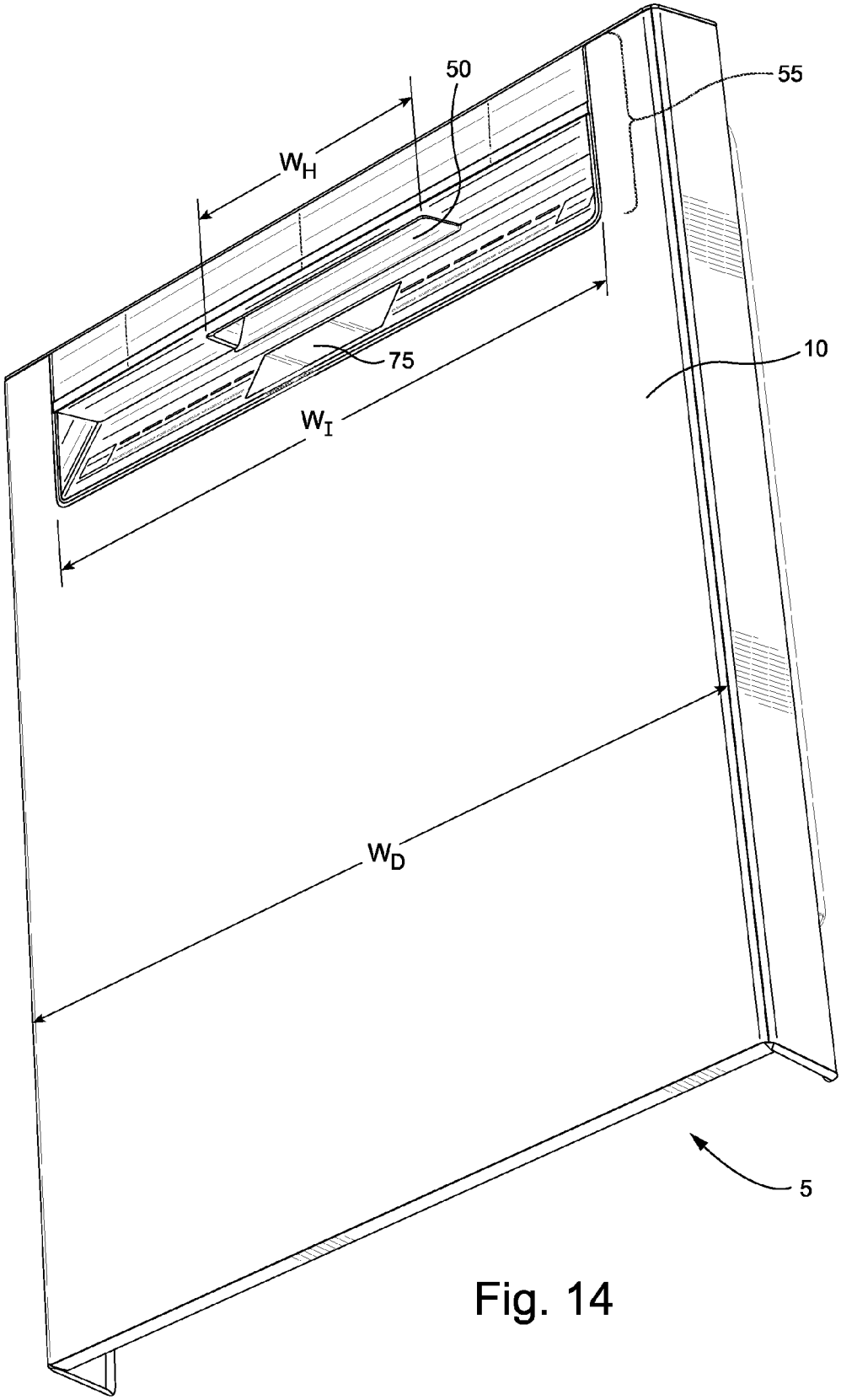

The door 10 includes a main body 60 (FIG. 3) and a shell 65 to cover the main body 10. The door 10 or shell 65 has a recess 70 or opening with upper and lower extents 70.1 and 70.2 (FIG. 10) to accommodate the insert 55 and/or handle 50. The shell 65 can be made of one piece construction (e.g., stainless steel), and has generally U-shape, as seen from FIGS. 4, 5, etc., in which the insert 55 is accommodated. The U-shape includes a pair of upstanding arms 65.1 between which the insert 55 is accommodated. The shell thus extends a height H from the kick plate 30 to just below the kitchen counter C. A top portion 55.6 (e.g., top edge of fascia 55.4) of the insert 55 is generally aligned and coextensive with a top portion 65.2 of each of the arms 65.1.

Figure 11:
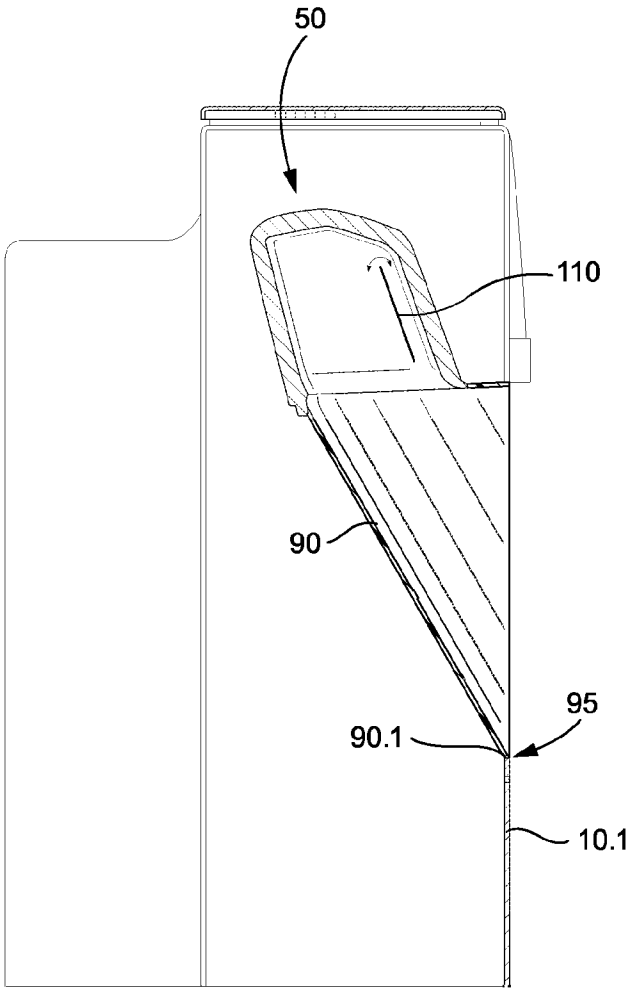
FIG. 11 is a cross section taken along line 11-11 of FIG. 5.

The insert 55 includes a display 75 and a control panel 80 (e.g., a plurality of push or touch sensitive buttons and/or LEDs 85) to control operation of the dishwasher 5. The display 75 and the control panel/buttons/LEDs 80, 85 are mounted on a surface 90 (FIGS. 10-11) of the insert that is angled inwardly (e.g., 5-80°, or about)40-65° relative to the front surface 10.1 of the closure device. A lower edge 90.1 of the surface 90 and the front surface 10.1 of the closure device intersect at a point 95 where the surface begins to angle inwardly towards of the closure device.

Figure 9:
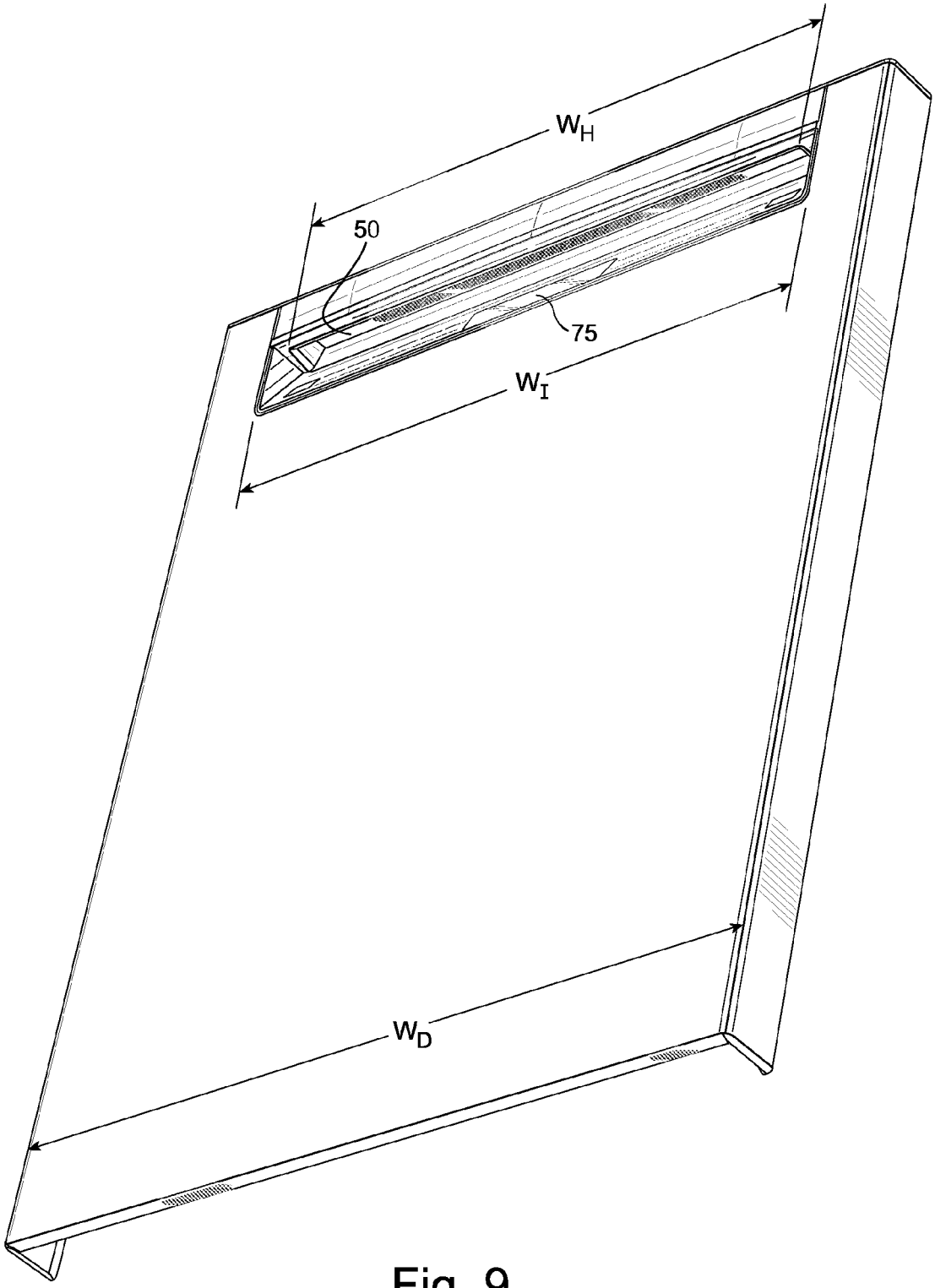
FIG. 9 is another perspective view thereof from the bottom.

The handle 50 is elongated in a horizontal sense, to such an extent that the handle is accessible by a user when standing at a position laterally adjacent the dishwasher (FIG. 1), e.g., a width $W_H$ (FIG. 9) of the handle 50 spans a majority of a width $W_D$ of the door 5. In specific examples, the width $W_H$ of the handle 50 is about 50-90% (e.g., 70-90%) of a width $W_D$ of the door 5, and/or the width $W_H$ of the handle 50 is about 60-95% (e.g., 70-90%) of a width $W_I$ of the insert 55. See FIGS. 9 and 12-14. The handle 50 is wider than the display 75 (e.g., 2-4 times), and/or the handle 50 has a width that spans all or a majority of the plurality of buttons/LEDs 85.

A locking device may be provided that locks the closure device in a locked position relative to the compartment during washing/drying. To actuate the locking device, the user need only close the door relative to the compartment, and upon reaching full or near full closure, the locking device springs or moves into place automatically, as is known. To unlock the locking device, a release mechanism 110 (schematically illustrated in FIGS. 10 and 11) may be ergonomically located so that a user's finger(s) inserted in the recessed handle 50 can "pinch" the release mechanism to unlock the door. The release mechanism could also be a touch sensitive surface/button. The width of the release mechanism 110 may be the same as the recessed handle 50, but it may have a width that is less than the width of the handle.

While the technology has been described in connection with several examples, it is to be understood that the technology is not to be limited to the disclosed examples, but on the contrary, is intended to cover various modifications and equivalent arrangements included within the spirit and scope of the technology. Also, the various examples described above may be implemented in conjunction with other examples, e.g., one or more aspects of one example may be combined with aspects of another example to realize yet other examples. Further, each independent feature or component of any given assembly may constitute an additional example.

What is claimed is:

1. A dishwasher comprising:

a compartment to hold items to be washed and/or dried, the compartment including a front opening;

a closure device to sealingly close the opening, the closure device being movable between open and closed positions, and comprising a one piece shell with a substantially U-shaped front profile with upstanding arm portions that are not connected by the one piece shell along an upper edge of the upstanding arm portion; and an insert having a front side with a portion that is flush or substantially flush with a front face of the closure device, the insert including a recessed handle that is inwardly recessed into the front face of the closure device, the handle being elongated in a horizontal sense and to such an extent that the handle and a release mechanism are accessible by a user when standing at a position laterally adjacent the dishwasher, wherein a width of the handle spans a majority of a width of the closure device and a portion of the release mechanism that is accessible by the user spans the majority of the width of the closure device.

2. The dishwasher as claimed in claim 1, wherein the closure device is a door hinged to the compartment to pivot about a horizontal axis that is generally parallel to the recessed handle, to move the door between the open and closed positions.

3. The dishwasher as claimed in claim 2, wherein the door has a recess to accommodate the insert.

4. The dishwasher as claimed in claim 2, wherein the insert is accommodated between the upstanding arm portions.

5. The dishwasher as claimed in claim 4, wherein a top portion of the insert is generally aligned and coextensive with a top portion of each of the arms.

6. The dishwasher as claimed in claim 1, wherein the insert includes a display and a control panel to control operation of the dishwasher.

7. The dishwasher as claimed in claim 6, wherein the display and the control panel are mounted on a surface of the insert that is angled inwardly relative to the front face of the closure device.

8. The dishwasher as claimed in claim 7, wherein a lower edge of the surface and the front face of the closure device intersect where the surface begins to angle inwardly.

9. The dishwasher as claimed in claim 6, wherein the handle and release mechanism are wider than the display.

10. The dishwasher as claimed in claim 6, wherein the control panel has a plurality of buttons, and the handle has a width that spans the plurality of buttons.

11. The dishwasher as claimed in claim 1, wherein a width of the handle spans a majority of a width of the closure device.

12. The dishwasher as claimed in claim 1, wherein a width of the handle is about 50-90% of a width of the closure device.

13. The dishwasher as claimed in claim 1, wherein a width of the handle is about 60-95% of a width of the insert.

14. The dishwasher as claimed in claim 1, wherein the closure device is a drawer that is slidable between the open and closed positions.

15. The dishwasher as claimed in claim 1, wherein the width of the portion of the release mechanism that is accessible by the user is the same as the width of the handle.

16. A dishwasher comprising:

a compartment to hold items to be washed and/or dried, the compartment including a front opening;

a door to sealingly close the opening, the door being pivotably attached to the compartment to allow pivoting about an axis between open and closed positions, the door including a main body and a one piece shell attached to the main body, the shell having a top portion with a generally U-shape and including upstanding arm portions that are not connected by the one piece shell along an upper edge of the upstanding arm portions; and a recessed handle inwardly recessed into a front face of the shell, the handle being elongated in a horizontal sense, generally parallel to the axis, and to such an extent that the handle is accessible by a user when standing at a position laterally adjacent the dishwasher, the handle being positioned between the upstanding arm portions of the U-shape.

17. The dishwasher as claimed in claim 16, further comprising a display and a control panel to control operation of the dishwasher.

18. The dishwasher as claimed in claim 17, wherein the display and the control panel are mounted on a surface below the handle, the surface being angled inwardly relative to the front face of the door.

19. The dishwasher as claimed in claim 17, wherein the handle is wider than the display.

20. The dishwasher as claimed in claim 16, wherein a width of the handle spans a majority of a width of the door.

21. The dishwasher as claimed in claim 16, further comprising a release mechanism that has a width the same as the handle.

22. The dishwasher as claimed in claim 16, further comprising a release mechanism that has a width the same as the handle and wherein a width of the handle spans a majority of a width of the door.

23. The dishwasher as claimed in claim 16, wherein an uppermost edge of the upstanding arm portions define an uppermost edge of the one piece shell.

24. The dishwasher as claimed in claim 16, further comprising a release mechanism that has a portion that is accessible by the user, the portion spanning a majority of a width of the door, and wherein a width of the handle spans the majority of the width of the door.

* * * * *